US011414287B2

(12) United States Patent
Spatz et al.

(10) Patent No.: US 11,414,287 B2
(45) Date of Patent: Aug. 16, 2022

(54) ROLLER FOR GUIDING AND/OR WIDTH STRETCHING OF A RUNNING MATERIAL WEB

(71) Applicant: Texmag GmbH Vertriebsgesellschaft, Thalwil (CH)

(72) Inventors: Michael Spatz, Waldberg (DE); Bernd Rester, Achsheim (DE)

(73) Assignee: Texmag GmbH Vertriebsgesellschaft, Thalwil (CH)

( * ) Notice: Subject to any disclaimer, the term of this patent is extended or adjusted under 35 U.S.C. 154(b) by 201 days.

(21) Appl. No.: 16/993,347

(22) Filed: Aug. 14, 2020

(65) Prior Publication Data

US 2021/0053785 A1 Feb. 25, 2021

(30) Foreign Application Priority Data

Aug. 23, 2019 (DE) ..... 102019005949.2

(51) Int. Cl.
*B65H 23/038* (2006.01)
*B65H 23/025* (2006.01)

(52) U.S. Cl.
CPC ..... *B65H 23/038* (2013.01); *B65H 23/0253* (2013.01); *B65H 2404/1231* (2013.01)

(58) Field of Classification Search
CPC ..... B65H 23/0253; B65H 23/038; B65H 2404/1231; D06C 3/16
See application file for complete search history.

(56) References Cited

FOREIGN PATENT DOCUMENTS

| | | | | |
|---|---|---|---|---|
| DE | 917304 | | 8/1954 | |
| DE | 1460639 | A1 * | 5/1969 | |
| DE | 102005021467 | A1 * | 11/2006 | ..... A46B 3/14 |

OTHER PUBLICATIONS

Search Report for DE 10 2019 005 949.2, dated May 19, 2020. "A" reference DE 917 304.

* cited by examiner

*Primary Examiner* — William E Dondero
(74) *Attorney, Agent, or Firm* — Joseph E. Maenner; Maenner & Associates, LLC

(57) ABSTRACT

A roller (1) is used for guiding and/or width stretching of a running material web (2). The roller (1) has a supporting body (3), on the outside of which receptacles (4) for axially displaceably held battens (5) are provided. These grasp the material web (2). In order to improve the functionality of this roller (1), at least one undercut groove (6) is formed on the supporting body (3) between at least two of the battens (5). This undercut groove (6) can receive at least one functional component (7).

11 Claims, 5 Drawing Sheets

ROLLER FOR GUIDING AND/OR WIDTH STRETCHING OF A RUNNING MATERIAL WEB

CROSS-REFERENCE TO RELATED APPLICATION

The present application claims priority to German Patent Application no: 10 2019 005 949.2, filed Aug. 23, 2019, which is incorporated herein by reference in its entirety.

FIELD OF THE INVENTION

The invention relates to a roller for guiding and/or width stretching of a running material web, wherein the roller has at least one supporting body. On the outside receptacles for axially displaceable battens which grasp the material web are provided on this supporting body.

BACKGROUND OF THE INVENTION

A generic roller is known from DE 1 460 639 A. This consists of a roller body in the outer side of which grooves are formed. H-shaped profiles which are configured to be elastic are formed in these grooves. These profiles grip the material web with the outer sides. The material web can be stretched in its width by opposing displacement of the individual profiles. This roller forms the starting point of the present invention.

BRIEF SUMMARY OF THE INVENTION

The invention is based on the object of providing a roller of the type mentioned initially which is characterized by an increased functionality.

This object is achieved by the following features.

A roller according to the invention is used for guiding and/or width stretching a running material web. Guiding is to be understood in this case as the change in position of the material web transversely to its running direction, wherein the material web width in this case remains substantially unchanged. Width stretching is understood on the other hand as the stretching the material web transversely to its running direction, wherein the centre of the material web remains substantially unchanged in its position. Naturally guiding and width stretching can also be performed in combination, i.e. simultaneously. The roller has at least one supporting body which is preferably held rotatably about an axis. Receptacles for battens are provided on the outside on the supporting body, on which axially displaceable battens are held. These battens can grip the material web indirectly or directly on the outside. In order to increase the functionality of the roller, at least one undercut groove is formed on the at least one supporting body between two of the battens, which groove serves to receive at least one functional component. This at least one functional component can in principle be axially displaceable like the battens. Usually however it is sufficient to connect the at least one functional component firmly to the at least one supporting body. The at least one functional component can easily grip between two battens due to the selected position of the at least one groove and thereby reach the material web.

In particular, under restricted space conditions it is advantageous if the receptacles of the battens overlap in the radial direction with the at least one groove to receive the functional component. A fastening foot of the at least one functional component—when viewed in the radial direction—thus grips under the battens so that even under restricted space conditions, a sufficiently secure hold of the at least one functional component is achieved.

In order to be able to connect at least one functional component optimally to the roller, it is advantageous if the at least one undercut groove has at least one threaded driving channel. Thus, the at least one functional component can be easily screwed to the roller. A threaded driving channel additionally has the advantage that at least one screw can be screwed in longitudinally to the at least one undercut groove at any arbitrary point without an aligning alignment with a threaded hole being necessary.

In order to achieve a space-saving arrangement, it is additionally advantageous if the at least one groove has at least one S-shaped undercut. In this way, the space between the receptacle of the battens on the one hand and the at least one groove for receiving the functional component on the other hand can be optimally utilized. In addition, a favourable shape for easy insertion of the at least one functional component is obtained in this way.

In order that the at least one functional component can have a spreading-out effect on the material web, it is favourable if said functional component has ribs which are inclined at an acute angle to a material web running direction which grip the material web. In this way, an advantageous spreading-out device is achieved which in particular rolls out the edges of the material web and prevents any rolling in again.

Alternatively or additionally, the at least one functional component can also comprise at least one brush. In this case, it is important for several functions that the at least one brush can also grip the material web.

In particular, as a result of obliquely arranged rows of bristles of the at least one brush, a spreading-out effect is achieved. In this case, the rows of bristles can be arranged obliquely in the axial direction or similarly to the aforesaid ribs. The at least one brush thereby presses against the material web and thereby causes a frictional force which is dependent on the speed of the material web. As a result of the obliquely arranged rows of bristles, this frictional force, which is originally directed in the running direction of the material web, is divided into a component in the direction of the series of bristles and a component transverse thereto. A force directed away from the centre of the material web is thus produced, which for example can smooth out rolled-in edges. Alternatively or additionally the bristles themselves can be aligned at an acute angle to the radial direction of the roller. A force aligned transversely to the web running direction is thereby also produced.

Alternatively or additionally, the rows of bristles of the at least one brush can be arranged in such a manner that a fixing effect is obtained. This should be understood to mean that as a result of the action of the at least one brush, the material web is prevented from contracting again to its original width after leaving the roller. In order to achieve a fixing effect, an obliquely outwardly aligned row of bristles is not required. However, the bristles are preferably arranged in such a manner that they enclose an obtuse angle with the vector of the material web running direction with the result that the bristles exert a corresponding normal force on the material web without substantially impeding the running of the material web.

Alternatively or additionally, the at least one functional component can also make an electrically conducting connection between the material web and the at least one supporting body. This is particularly important in the case of insulating material webs which can be charged electro statically since surface charges can easily be diverted in this way. Such surface charges can hinder further process steps to which the material web is subjected or interfere with subsequent devices.

The at least one functional component can have at least one sliding surface for the material web. The sliding surface prevents edges of the battens from being able to press into the material web so that the material web need not be smoothed again. In particular, sensitive material webs such as natural silk, thin plastic films or thin metal films can be protected in this way and the formation of pressed-in batten edges can be prevented.

In particular, if the process step following the roller requires a smooth material web, the sliding surface of the functional component is advantageous. Alternatively or additionally, this sliding surface can also be inclined obliquely to the material web running direction in order to achieve a spreading-out effect on the material web in this way.

For the sliding surface it has proved to be favourable if said sliding surface is curved in the circumferential direction of the at least one supporting body. Preferably the sliding surface is aligned and tangential to the two neighbouring battens so that no edges which could press into the material web are formed on the surface of the roller.

Naturally the configurations of the functional components described above can also be combined in any manner in order to fulfil several functions simultaneously.

BRIEF DESCRIPTION OF DRAWINGS

Other advantages and characteristics of this invention will be explained in the detailed description below with reference to the associated figures that contain several embodiments of this invention. It should however be understood, that the figure is just used to illustrate the invention and does not limit the scope of protection of the invention.

DETAILED DESCRIPTION OF THE INVENTION

Figure 1:
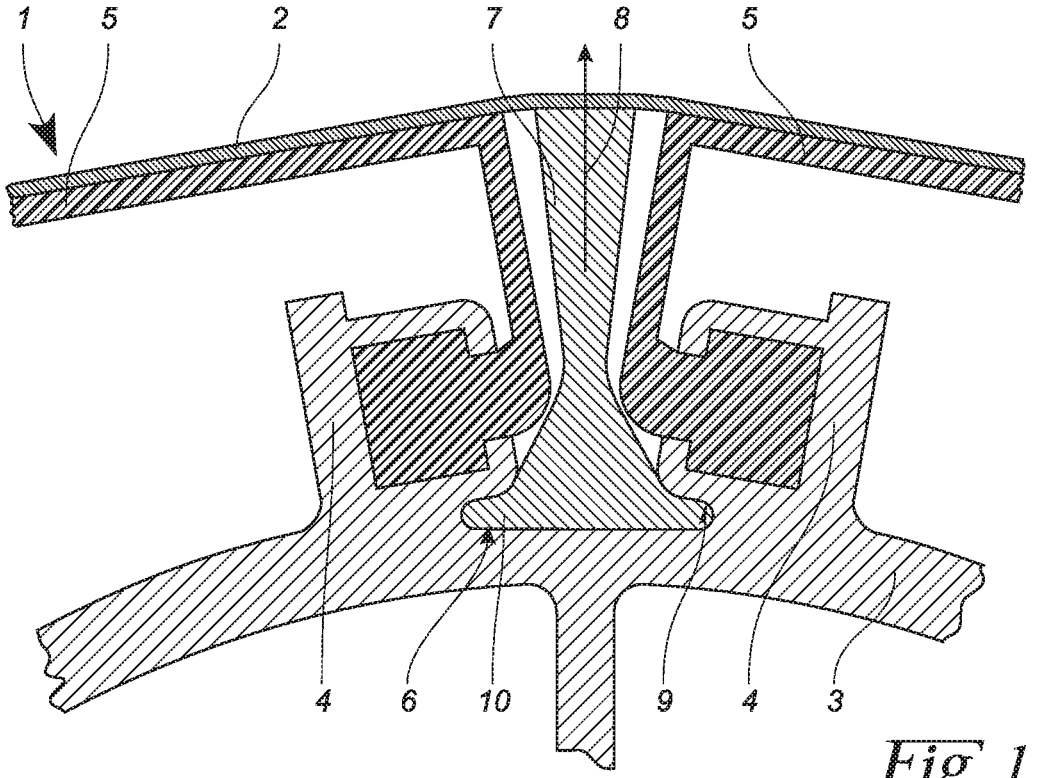
FIG. 1 shows a sectional diagram of a section of a roller perpendicular to a roller axis.

FIG. 1 shows a sectional diagram of a roller 1 for guiding or width stretching of a running material web 2. In order to be able to better identify the details, the figures shows only a small section of the roller 1 and the material web 2. The roller 1 has a supporting body 3 which is constructed to be substantially cylindrical. The supporting body 3 is held rotatably about an axis which is not shown, wherein the axis is aligned perpendicular to the image plane according to FIG. 1.

Provided on the outside of the supporting body 3 are receptacles 4 for battens 5 which are supported axially displaceably with respect to the supporting body 3. Although the battens 5 are shown in one piece in the exemplary embodiments, they can also be configured to be multi-part. In particular, it is intended to form the battens 5 as batten bodies with a covering applied thereto. This covering can then be optimized to the particular requirements of the respective material web 2. These battens 5 grip the material web 2, wherein an axial movement of the batten 5 is transmitted to the material web 2. The material web 2 can thus be guided, i.e. changed in its position and/or width stretched, i.e. changed in its width. The receptacles 4 are configured as undercut in this case in order to ensure a secure hold of the battens 5 in the receptacles 4.

In addition, an undercut groove 6 in which a functional component 7 is supported is provided in the supporting body in each case between the battens. Since the space between the battens 5 is usually very small, the undercut groove 6—when viewed in the radial direction 8—grips partially under the battens 5. In this region the supporting body 3 is configured to be sufficiently thick-walled so that the associated material weakening of the supporting body 3 does not play any part. In order to be able to introduce the functional component 7 easily into the undercut groove 6 or withdraw it from said groove, an undercut 9 is configured to be S-shaped. This shape additionally has the advantage that it is inserted in a space-saving manner into the supporting body 3. A suitably shaped foot 10 of the functional component 7 engages in the undercut groove 6, which in this way is held securely in the supporting body 3. This foot 10 is preferably configured to be elastically deformable in order to ensure a play-free fit of the functional component 7 in the undercut groove 6 in this way. This is particularly important in those cases of application in which the alignment of the functional component 7 is important.

Figure 2:
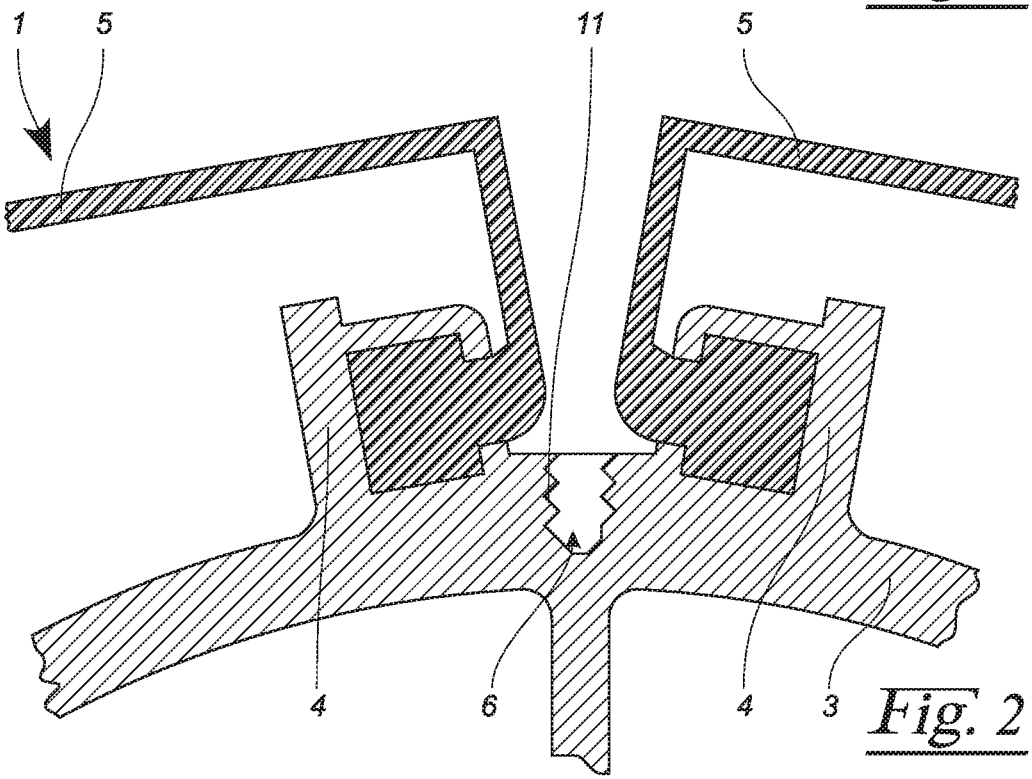
FIG. 2 shows a sectional diagram according to FIG. 1 of an alternative embodiment.

FIG. 2 shows an alternative embodiment of the roller 1 wherein the same reference numbers designate the same components. Only the differences with respect to the embodiment according to FIG. 1 will be discussed hereinafter.

In the embodiment according to FIG. 2, the undercut groove 6 is configured as a threaded driving channel 11 so that in this way a functional component not shown can be very easily screwed to the roller 1. In this way a good fixing of the functional component on the roller 1 is achieved even in the axial direction. This can be important in particular when the functional component is intended to transmit axial forces to the running material web 2.

The functional component 7 is explained in detail with reference to the diagrams according to FIGS. 3 to 9.

Figure 3:
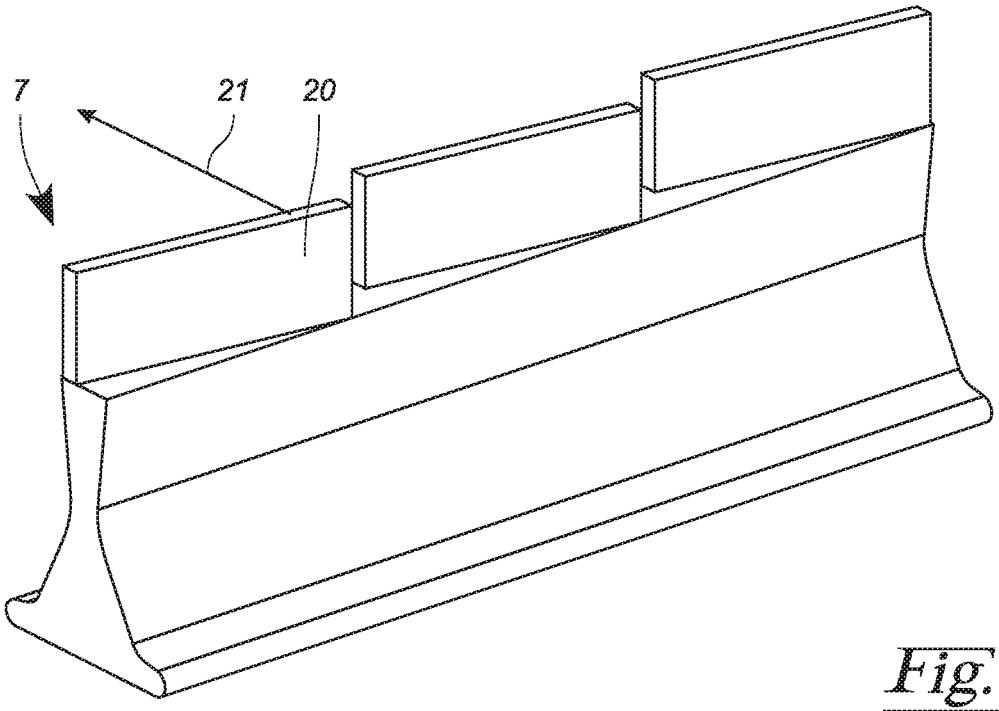
FIG. 3 shows a three-dimensional diagram of a functional component with ribs inclined at an acute angle.

FIG. 3 shows a functional component 7 on which ribs 20 are arranged on the outer side. These ribs 20 are inclined at an acute angle to a material web running direction 21 and in this way produce an outwardly directed force on the material web 2. These ribs 20, for example, provide for rolling out rolled-in material web edges or prevent rolling out again of the edges. For this purpose, the ribs 20 are arranged mirror-symmetrically to the depicted ribs 20 in the region of the other subject matter in order to roll out corresponding left and right material web edges.

Figure 4:
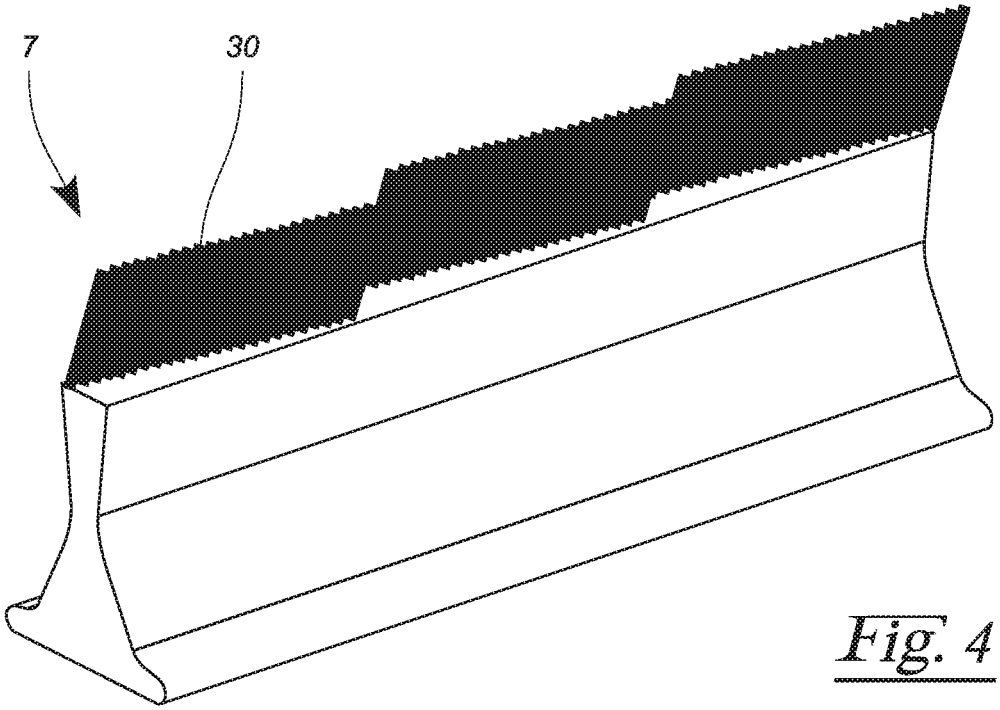
FIG. 4 shows a three-dimensional diagram of a functional component with brushes.

FIG. 4 shows an alternative embodiment of the functional component 7. In this functional component the ribs 20 are replaced by brushes 30. These brushes 30 can, on the one hand have a spreading-out effect and/or a fixing effect on the material web 2. Fixing effect is understood in this case to be a measure which ensures that the material web 2 remains in the width-stretched position.

The brushes 30 are in this case inclined in such a manner that they are each inclined with respect to the nearest roller end. By this means, the spreading-out effect is increased accordingly. Alternatively the brushes 30 can also be aligned in the radial direction so that the brushes 30 only have a corresponding spreading-out effect transversely to the running direction as a result of their arrangement. As a further alternative, it is additionally intended not to use the rib-like inclination of the brushes 30 and instead arrange the brushes 30 axially one behind the other.

Figure 5:
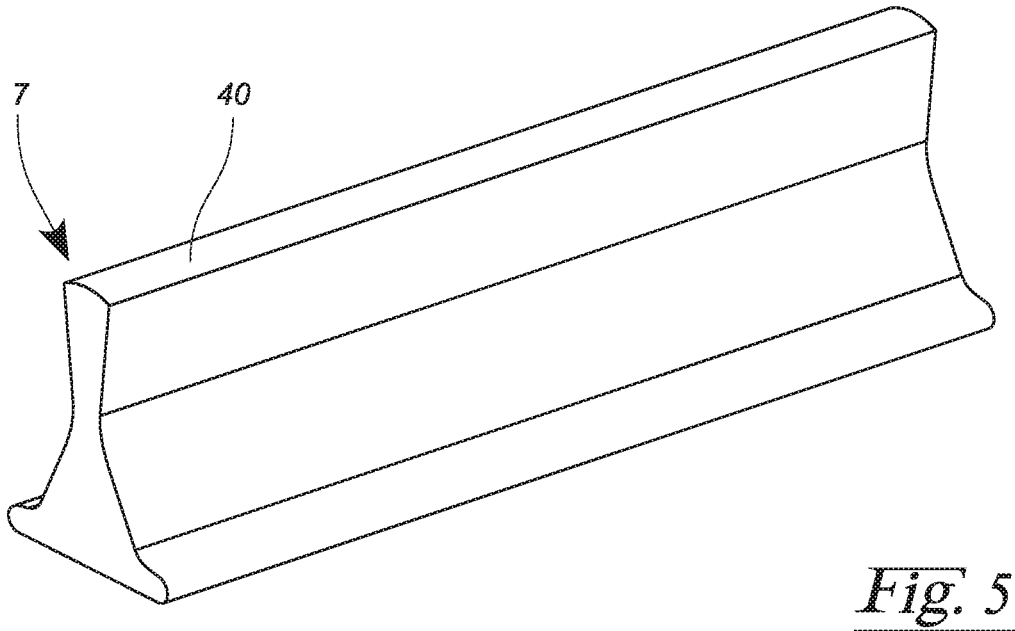
FIG. 5 shows a three-dimensional diagram of a functional component with a sliding surface.

FIG. 5 shows a further embodiment of the functional component 7. This has a sliding surface 40 in the outer region which is configured tangentially and in alignment to the adjoining battens 5 on both sides. This sliding surface 40, for example, prevents the formation of pressed in batten edges. This sliding surface 40 is particularly important in those cases in which the battens 5 are divided in order to achieve a spreading-out effect on the material web 2 in addition to a guiding effect. As a result of this division however, there is a gap above which the material web 2 is not supported. This gap can advantageously be bridged by the sliding surface 40 of the functional component 7 in order to avoid an increased stressing of the material web 2.

Figure 6:
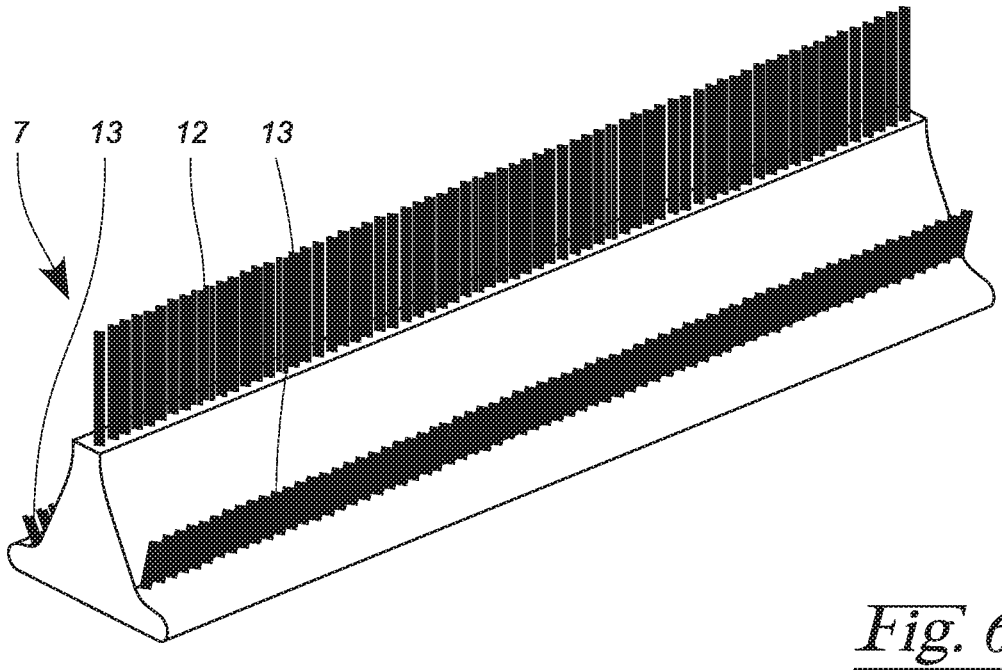
FIG. 6 shows a three-dimensional diagram of a functional component for protection from electric charging.

FIG. 6 shows a three-dimensional diagram of a further functional component 7. This functional component 7 has electrically conducting brushes 12, 13 which contact the material web 2 and/or at least one of the battens 5. In this way, an electrical connection to the roller 1 is obtained. A static charging of the running material web 2 or the batten 5 is thus prevented which could result in electrical flashovers or impairment of the function of subsequent electrical assemblies. Such a measure is only expedient in the case of electrically insulating material webs 2, especially as even slightly conducting material webs 2 show no electrical charging phenomenon.

In this case, the electrically conducting brushes 12 directly contact the material web 2 whereas the electrically conducting brushes 13 only make an electrical connection with the battens 5. Depending on the case of application, the brushes 12 or 13 can also be dispensed with.

Figure 7:
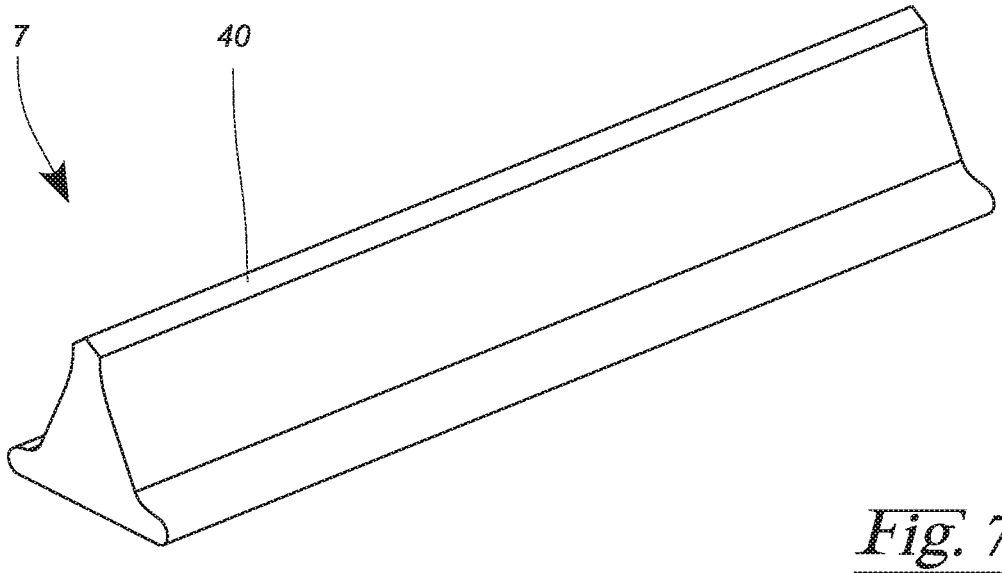
FIG. 7 shows a three-dimensional diagram of a functional component as a sliding support.

FIG. 7 shows a three-dimensional diagram of a further functional component 7 with a supporting function. This functional component 7 in this case supports the battens 5 on the inside in the radial direction. This is important with high loads on the battens 5 in order to avoid any bending of the battens 5. On the upper side this functional component 7 has sliding surfaces 40.

Figure 8:
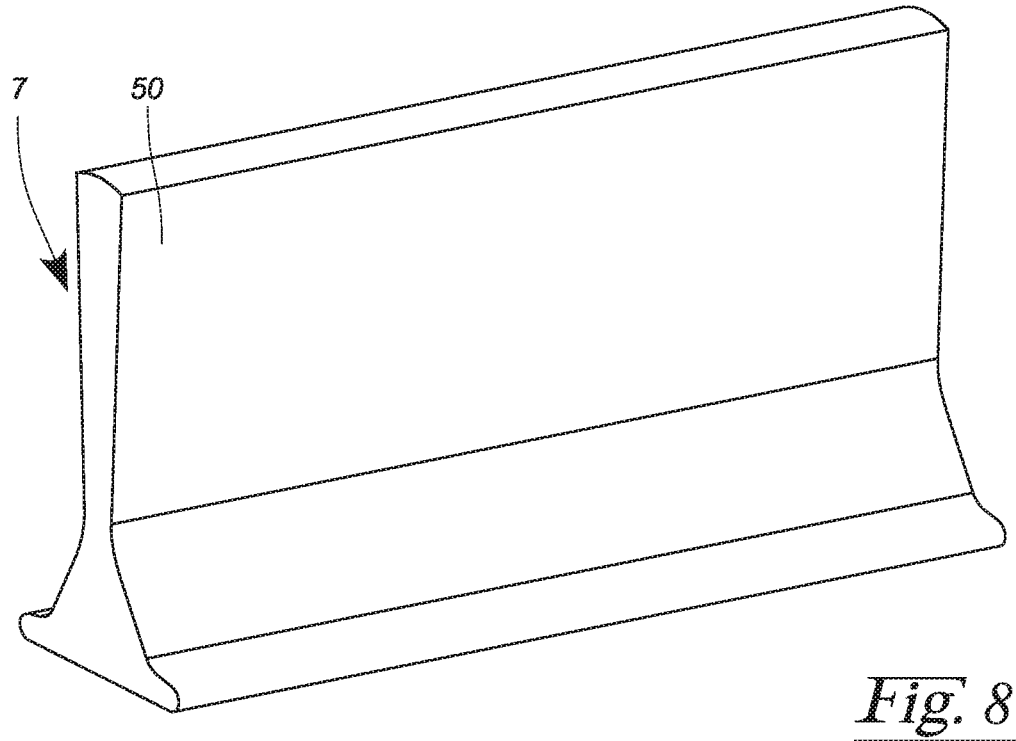
FIG. 8 shows a three-dimensional diagram of a functional component as transport protection and FIG. 9 shows a three-dimensional diagram of a functional component for cleaning the battens.

FIG. 8 shows a three-dimensional diagram of a further functional component 7 with a transport securing function. The functional component 7 is constructed similarly to the embodiment according to FIG. 5, wherein a support 50 projects considerably radially beyond the battens 5. In this way, during transport of the roller 1 it is reliably prevented that undesired forces act on the battens 5. For operation this functional component 7 must be disassembled.

Figure 9:
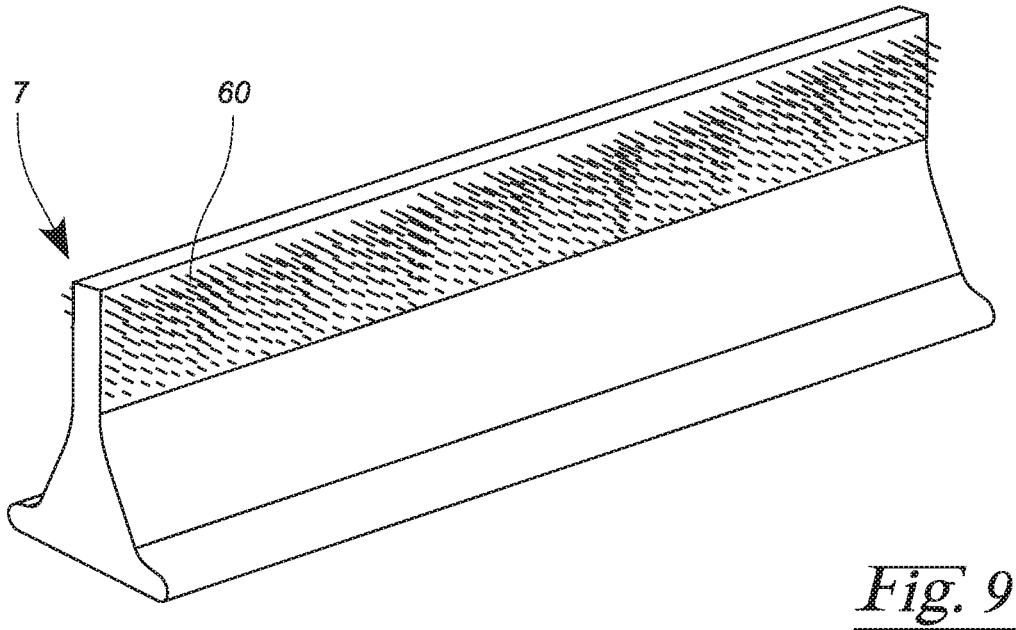

FIG. 9 shows a three-dimensional diagram of a further functional component 7 with a cleaning function. This functional component 7 has bristles 60 aligned in the radially outer region approximately in the circumferential direction of the roller 1 which clean the battens 5 during their axial movement. In principle the bristles 60 can be provided with a physical or chemical cleaning means. Usually however the mechanical effect of the bristles is completely sufficient to clean the battens 5.

The depicted and described embodiments of the functional component 7 can also be used in any combination.

Since some of the embodiments of this invention are not shown or described, it should be understood that a great number of changes and modifications of these embodiments is conceivable without departing from the rationale and scope of protection of the invention as defined by the claims.

What is claimed is:

1. A roller for at least one of guiding and width stretching of a running material web, wherein said roller has at least one supporting body, said supporting body having an outside, receptacles are provided on said outside, said receptacles axially displaceably holding at least two battens, said battens grasp said material web, at least one undercut groove is formed on said at least one supporting body between said at least two battens, said at least one groove can receive at least one functional component.

2. The roller according to claim 1, wherein said roller having a radial direction and said receptacles of said battens overlap in said radial direction with said the at least one groove to receive said at least one functional component.

3. The roller according to claim 1, wherein said at least one undercut groove has at least one threaded driving channel.

4. The roller according to claim 1, wherein said at least one groove has at least one S-shaped undercut.

5. The roller according to claim 1, wherein said material web has a running direction and said at least one functional component has ribs which grip said material web and which are inclined at an acute angle to said running direction.

6. The roller according to claim 1, wherein said at least one functional component comprises at least one brush.

7. The roller according to claim 6, wherein said at least one brush has an effect which spreads out said material web.

8. The roller according to claim 6, wherein said at least one brush has an effect which fixes said material web.

9. The roller according to claim 1, wherein said at least one functional component makes an electrically conducting connection between said at least one supporting body on one hand, and at least one of said material web and said battens, on the other hand.

10. The roller according to claim 1, wherein said at least one functional component has at least one sliding surface for said material web.

11. The roller according to claim 10, wherein said supporting body has a circumferential direction and said sliding surface is curved in said circumferential direction.

* * * * *